US006452562B1

(12) United States Patent
Nyhus

(10) Patent No.: US 6,452,562 B1
(45) Date of Patent: Sep. 17, 2002

(54) ANTENNA SYSTEM FOR GROUND BASED APPLICATIONS

(75) Inventor: Orville K. Nyhus, Glendale, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/589,912

(22) Filed: Jun. 7, 2000

Related U.S. Application Data

(60) Provisional application No. 60/137,880, filed on Jun. 7, 1999.

(51) Int. Cl.[7] ..... H01Q 21/08
(52) U.S. Cl. ..... 343/810; 343/844
(58) Field of Search ..... 343/810, 736, 343/731, 844, 824, 845, 719, 853, 854

(56) References Cited

U.S. PATENT DOCUMENTS

| | | | | |
|---|---|---|---|---|
| 3,733,611 A | * | 5/1973 | Becavin | 343/792 |
| 3,780,372 A | | 12/1973 | Unz | 343/719 |
| 4,075,635 A | | 2/1978 | Unz | 343/844 |
| 4,446,465 A | | 5/1984 | Donovan | 343/797 |
| 5,534,882 A | | 7/1996 | Lopez | 343/891 |
| 5,966,102 A | * | 10/1999 | Runyon | 343/820 |
| 6,201,510 B1 | | 3/2001 | Lopez et al. | 343/799 |

OTHER PUBLICATIONS

"GPS Antenna, Omni Directional Model dBs200," dBs Part No. 200300–100, dBSystems, Inc.
Charles C. Counselman III, Professor of Planetory Sciences, Massachusetts Institute of Technology, "Array Antennas for DGPS", 1/98m 1998 IEEE, pp. 352–357.
Michael Braasch, Ohio University, Optimum Antenna Design for DGPS Ground Reference Stations:, Sep. 1994, pp. 1291–1297.
"Design of Unequally Spaced Arrays for Performance Improvement" IEEE Transactions on Antennas and Propagation, US, IEEE Inc. New York, vol. 47, No. 3, Mar. 1999, pp. 511–523.
European Search Report, Mar. 26, 2001, Application No. EP 00 65 0064.

* cited by examiner

*Primary Examiner*—Tho Phan
*Assistant Examiner*—James Clinger

(57) ABSTRACT

An antenna system is disclosed having a plurality of vertically-distributed elements. The orientation of the elements provides an improved linear array pattern covering the upper hemisphere with a sharp cut-off at a relatively small angle above the horizon. Each of the elements are distanced from each other by, for example, $\alpha\lambda/2$, wherein the unitless constant, $\alpha$, is less than unity.

20 Claims, 3 Drawing Sheets

ANTENNA SYSTEM FOR GROUND BASED APPLICATIONS

CROSS REFERENCE TO RELATED APPLICATIONS

This application claims priority from U.S. Provisional Application No. 60/137,880 filed Jun. 7, 1999.

FIELD OF THE INVENTION

The present invention relates generally to an antenna system and, more particularly, to an improved antenna system for ground applications.

BACKGROUND OF THE INVENTION

The operation of Remote Satellite Measurement Units (RSMUs) with Satellite Landing System (SLS) ground stations is particularly susceptible to multi-path errors. Such errors typically originate from the illumination of the antenna by rays that are reflected from the earth or surface objects and structures. Thus, it is desirable to design a ground-based system that would acquire emissions that originate above the horizon, but reject rays that arrive from below the horizon. Antenna systems that exhibit such a sharp radiation cut-off pattern are typically very large.

Previous attempts to reduce multi-path errors have employed L-band antenna designs. These efforts have met with limited success. Early trials involved patch antennas and quadri-filar helix designs. To help improve the performance of these antennas, choke rings were introduced around the bases of the basic antenna elements in an attempt to reduce the response to signals that reflect from the earth and other objects below the horizon. In addition, "lift kits" have been installed with patch antennas to raise the patches to various heights above the choke ring base of the antenna. While some of these trials have met with limited success, none have satisfactorily eliminated the multi-path errors.

The latest attempt to reduce multi-path errors uses a large array having a vertical array of vertically polarized dipoles and a second antenna which is a heli-bowl mounted above the vertical dipole array. The vertical dipole array provides coverage of lower elevation angles and cuts off sharply below an elevation of approximately 5–10 degrees. Furthermore, the vertical dipole array also cuts off at higher elevation angles in the range of about 35–40 degrees above the horizon. As may be appreciated, coverage of elevation angles near the zenith would be fundamentally limited with the vertical dipole array as the vertical dipole elements do not radiate or receive in the vertical direction.

Regardless of the array construction, coverage typically will not be provided for a direction in which the basic elements do not radiate or receive. Therefore, two antenna sections are configured for coverage of the low elevation angles and the high elevation angles. More specifically, the vertical dipole array is provided for the low elevation angles and the heli-bowl is provided for the high elevation angles.

A two antenna configuration, including the heli-bowl and vertical dipole array combination, typically requires the use of two separate receiver channels. The signals from the two antenna sections cannot be combined into a single analog or digital signal prior to signal detection because at some elevation angles, the summation of two Radio Frequency (RF), Intermediate Frequency (IF), or digital signals will result in a signal aiding or cancellation in the common region where the radiation patterns of the two sections overlap. This results in undesirable pattern nulls and peaks commonly referred to as grating lobes. While the situation involving peaks in an antenna pattern due to signal aiding is not generally considered to be a problem, nulls resulting from signal cancellation are undesirable due to a reduction in coverage volume.

In addition to the disadvantages associated with signal cancellation in a two antenna configuration, the required use of two receivers for this antenna type imposes a cost penalty. For example, a single SLS ground station is typically outfitted with three RSMUs. Therefore, a two antenna configuration would typically require six receivers for each SLS ground station. In addition, synchronization between multiple RSMUs at each site must be resolved, and a switching threshold algorithm is needed to select the proper receiver output based on elevation angle, signal quality, or some other appropriate parameter.

U.S. Pat. No. 5,534,882, issued Jul. 9, 1996 to Lopez, discloses an antenna system having upper hemisphere coverage close to the zenith and is hereby incorporated by reference. Referring to FIG. 1, a computer-generated plot of antenna gain versus elevation angle for the Lopez system is illustrated. As shown, the gain is uneven from the horizon to the zenith (0 to 90 degrees). There is a sharp cutoff at the horizon with the sidelobes approximately 10 dB+ down.

In view of the foregoing, an antenna array is desired that is constructed with basic elements and provides improved isotropic coverage of the upper hemisphere while rejecting signals that arrive from below a suitable threshold above the horizon (i.e., upper hemisphere coverage with a sharp cut-off near the horizon). In addition, it is desirable to stabilize the gain from the horizon to the zenith.

SUMMARY OF THE INVENTION

Various embodiments of the present system overcome the prior art problems by providing an improved antenna comprising a plurality of vertically-distributed element arrays configured to cover the upper hemisphere while providing a sharp cut-off at a relatively small angle above the horizon.

In accordance with a further aspect of the present invention, an antenna includes a plurality of element arrays distanced by at least $\alpha\lambda/2$, wherein $\alpha$ is an unitless constant and $\lambda$ is the wavelength.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE EXEMPLARY EMBODIMENT

The ensuing description refers to exemplary embodiments only, and is not intended to limit the scope, applicability, or configuration of the invention in any way. Rather, the ensuing descriptions provide a convenient description for implementing exemplary embodiments of the invention, it being understood that various changes may be made in the function and arrangement of elements described in the embodiments without departing from the spirit and scope of the invention as set forth in the appended claims.

Figure 1:
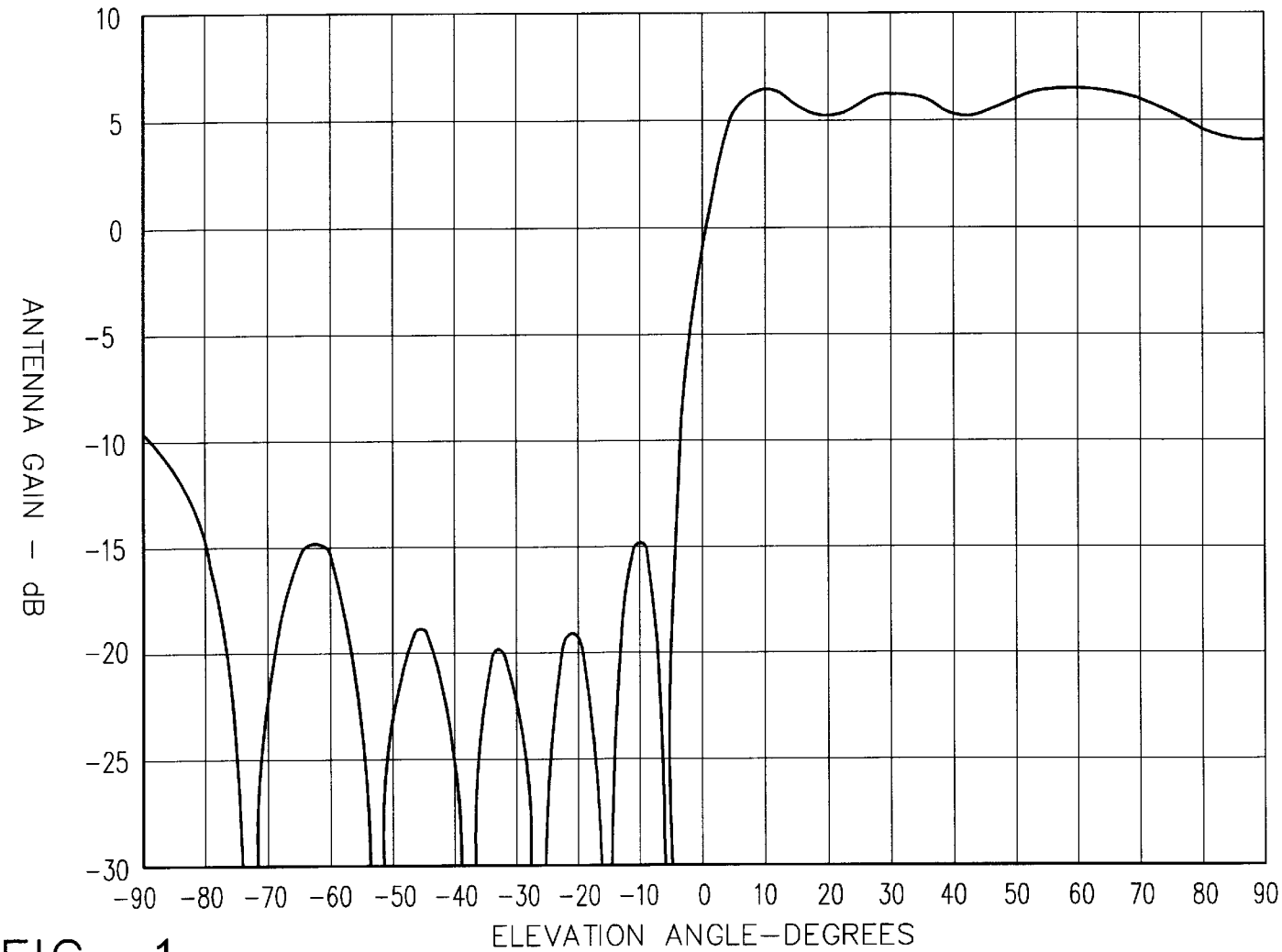
FIG. 1 (PRIOR ART)
FIG. 1 is a computer-generated antenna pattern illustration of the prior art.
Figure 2:
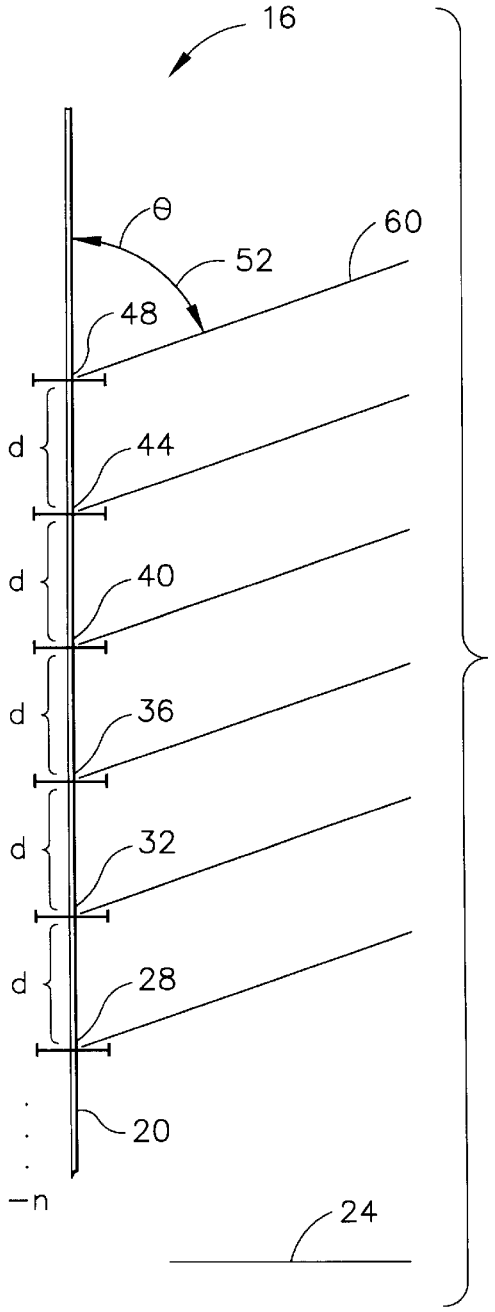
FIG. 2 illustrates an antenna system in accordance with one embodiment of the present invention.

Referring now to FIG. 2, an antenna system 16 in accordance with various aspects of the present invention includes a mast 20 that is substantially normal to the horizon 24. The mast 20 supports a linear array of isotropic radiating (or receiving) elements formed of multiple vertically oriented elements 28, 32, 36, 40, 44 and 48. Each vertically oriented element (i.e., 28, 32, 36, 40, 44, 48) generates a propagation ray 60. It should be appreciated that the angle from zenith ($\theta$) (e.g., as illustrated in FIG. 1, $\theta$=52°) is the complement of the elevation angle (i.e., the angle between propagation rays 60 and horizon 24). The vertically oriented elements being separated a distance (d) from each other.

The vertically oriented elements, in accordance with the present invention, are configured to be circularly polarized in the zenith direction and become elliptically polarized at the lower elevation levels while maintaining satisfactory axial ratio values. The orientation of the elements provides a linear array pattern covering the upper hemisphere with a sharp cut-off at a relatively small angle above the horizon, such as about 5°. The exemplary embodiment illustrated as antenna system 16 includes six vertically oriented elements 28, 32, 36, 40, 44, 48 forming the linear array of isotropic radiating elements. However, it will be appreciated that the number of vertically oriented elements may be increased or decreased without departing from the scope of the invention. The total coverage volume is substantially the same as for the vertical dipole array and heli-bowl antenna combination previously described above.

Due to the isotropic nature of elements 28, 32, 36, 40, 44 and 48, equal response theoretically exists in all directions. However, it should be appreciated that each element radiates electromagnetic energy at an amplitude and phase which depends on the RF power and phase of the drive signal applied to the element.

Furthermore, the net electromagnetic field at a distant observation point is typically the sum of all the fields from the individual elements (it is assumed that the observation point is sufficiently far from the array that the propagation paths can be approximated as being parallel). In addition, because the relative distances of propagation are dependent on the elevation angle with respect to the observation point, the distance traveled by each individually propagated signal is different and corresponding phase delays are the result. At the observation point, the phase of an individual component of the electromagnetic field is advanced or delayed relative to the phases of the signals generated by the other elements. Accordingly, it is desirable to design the physical dimensions of the array to produce the necessary relative propagation distances as a function of elevation angle. Additionally, the individual elements are powered with RF signals such that the electromagnetic fields at the distant observation point add for elevations in which signal coverage is desired and subtract/cancel for elevations in which signal rejection is desired.

In one embodiment, the antenna array is configured to receive signals from about 5° to 10° and upward, and to reject signals at and below the horizon by about 40 dB. The number and spacing of the vertically orientated elements, as well as their relative amplitudes and phases, may be optimized in accordance with the disclosure.

Figure 3:
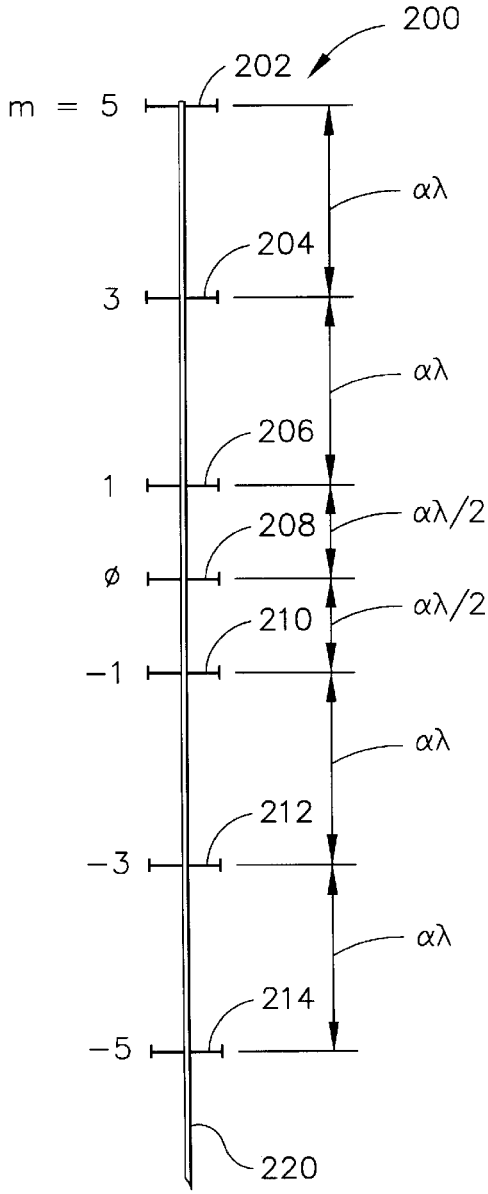
FIG. 3 illustrates an antenna system in accordance with an embodiment of the present invention.

One particular embodiment in accordance with the present invention is illustrated in FIG. 3. An antenna 200 includes seven isotropic elements (i.e., m =−5, −3, −1, 0, 1, 3, and 5; elements 214, 212, 210, 208, 206, 204, and 202 respectively). In this embodiment, the elements are distributed along a mast 220 symmetrically with respect to element 208. Elements 206 and 210 lie at a distance $\alpha\lambda/2$ from element 208, where $\alpha$ is an unitless constant, and $\lambda$ is the signal wavelength. The remaining elements, 202, 204, 212 and 214, are distanced at $\alpha\lambda$ intervals.

It should be appreciated that the antenna configuration shown in FIG. 3 is effectively an eleven-element design (having elements distanced at $\alpha\lambda/2$ intervals) that has been "thinned" to seven elements. This configuration allows elements which may be driven at diminishingly low levels to be removed without significantly altering the performance of the antenna.

Antenna elements 202–214 are crossed, orthogonal, inverted-vee dipole elements fed in quadrature. This configuration produces circular polarization in the two directions perpendicular to the plane of the dipoles (e.g., upward and downward for horizontal dipoles). However, the axial ratio in such systems degrades in directions away from the perpendicular axis and becomes linearly polarized in the plane of the dipoles. this embodiment having crossed, inverted-vee dipoles does offer a desired lower degradation.

The individual elements are driven at specific amplitude and phases to achieve suitable cancellation of signals below a threshold elevation angle. The antenna array illustrated in FIG. 3 includes a feed network (not shown) to drive each element. The network suitably includes signal couplers configured to establish the correct amplitudes and delay lines (transmission lines, e.g., microstrip, stripline) to produce the correct phases for each of the individual elements. The network further incorporates the necessary quadrature feed for the crossed inverted-vee dipoles. There are various techniques used by those of skill in the art for adjusting the resultant antenna radiation pattern. For example, one common technique uses Fourier Series analysis to determine amplitude and phase weighting for each of the antenna elements. For further background information regarding antenna theory, see, e.g., Constantine Balanis, Antenna Theory Analysis and Design (1982) hereby incorporated by reference. Iteration of the current amplitude and phase at each element may be performed using optimization techniques. This optimization may suitably be performed manually (derivation methods) or by automated/programming means well known to those of skill in the art.

As previously stated, the present invention alters the conventional element spacing of $\lambda/2$ by a factor of "$\alpha$". In a similar manner as is commonly used to determine amplitude and phase for each element, a suitable "$\alpha$", as disclosed herein, may be determined through optimization techniques. For instance, physical construction (iteration; trial and error) and/or simulations (computer programming methods) may be used to refine/optimize the solution accounting for the element to element spacing. In this manner, optimization techniques of the present invention include optimizing the amplitude, phase, and element spacing (i.e., $\alpha$) for each element. In one particular technique, a suitable programming model may be used to determine mathematically one or more $\alpha$ values. In this sense, a computer program, such as a spreadsheet, may be programmed to provide simulations of various antenna patterns. A succession of $\alpha$ values may be input to analyze the generated outputs and determine which $\alpha$ provides the desired pattern.

Table 1: Exemplary Drive Coefficients

Figure 4:
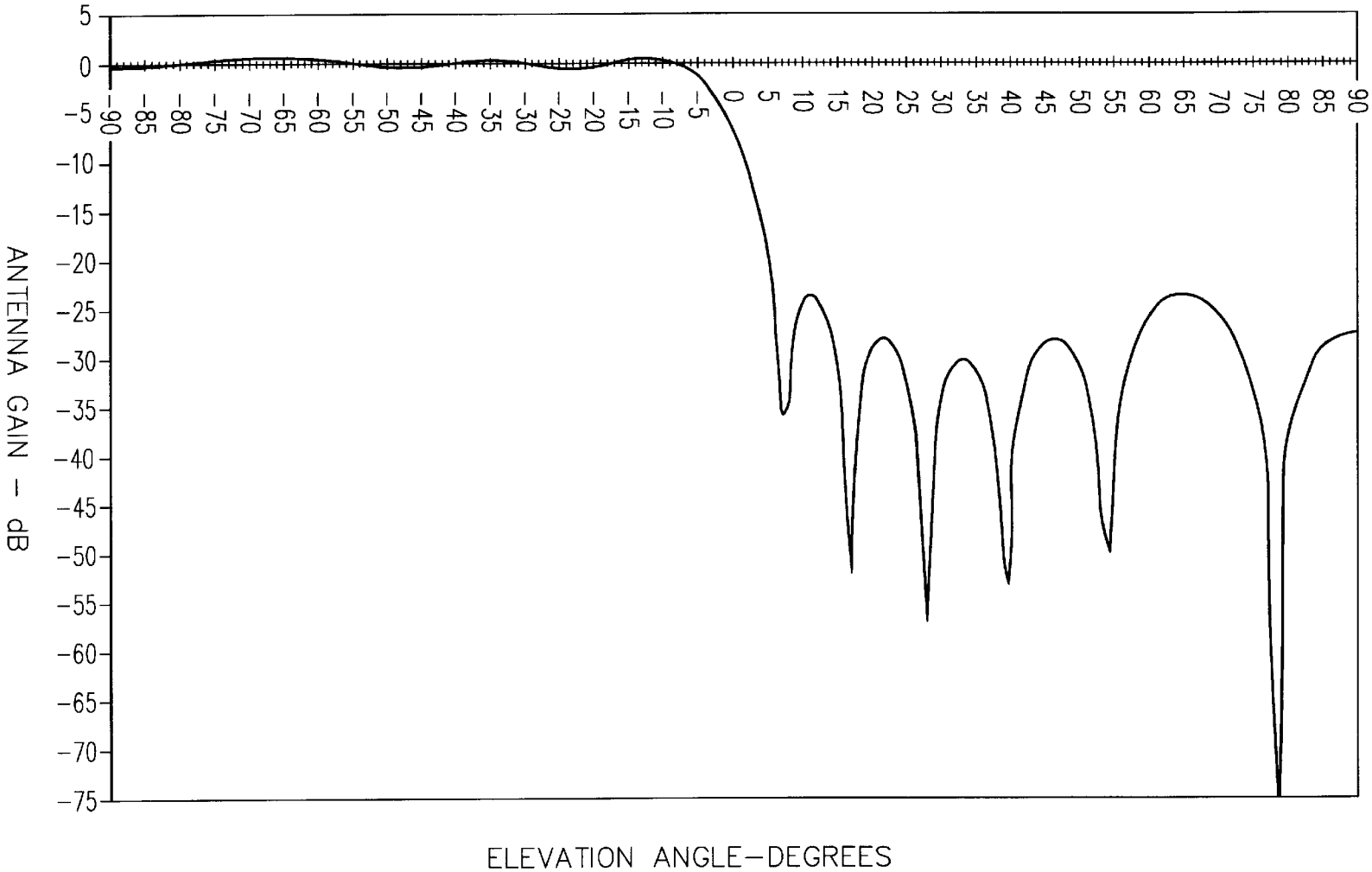
FIG. 4 is a computer-generated antenna pattern in accordance with an embodiment of the present invention.

Referring now to FIG. 4, an exemplary computer-generated antenna pattern in accordance with the values of Table 1 is shown. The ultimate antenna pattern is the array factor multiplied by the antenna pattern of the individual elements. The center element (m=0) is driven at −6 dB and $\alpha \cong 0.90$. FIG. 4 demonstrates the improved uniformity in gain from the horizon to the zenith (0 to 90 degrees) over the prior art pattern illustrated in FIG. 1. In addition, below the horizon all sidelobes are indicated to be at least −20 dB down from the horizon.

The unitless parameter $\alpha$ may be varied in accordance with the particular application. In the illustrated embodiment, $\alpha$ is a real number less than unity, preferably in the range of 0.90–0.99. However, it should be appreciated that other amplitude values may be suitable depending upon particular design requirements. The present inventors have found that by scaling the conventional distance ($\lambda/2$) between the elements by $\alpha$ (i.e., $\alpha\lambda/2$) significantly improves the pattern of the antenna system. Those skilled in the art will clearly recognize the improved antenna pattern in accordance with the present invention with a comparison of the antenna pattern of the prior art (FIG. 1) and the exemplary antenna pattern in accordance with the present invention (e.g., FIG. 4). It should be appreciated that FIG. 4 is merely exemplary of a specific pattern for the values of Table 1 herein, where $\alpha \cong 0.90$, and is not intended to be limiting. Rather, as previously stated, $\alpha$ may be varied according to the particular application, e.g., number of elements, desired amount of signal rejection near the horizon, drive coefficients, etc.

Each element, namely 202, 204, 206, 208, 210, 212, and 214, in the illustrated embodiment are substantially isotropic. Ideally, it is desirable to use elements as nearly isotropic as possible, however, in practice, a truly isotropic radiation pattern is generally rare. In one embodiment, the antenna polarization is right-hand circular polarization (RHCP). In this embodiment, the individual elements radiate (and receive) RHCP electromagnetic signals.

An antenna array in accordance with one embodiment, having individual elements which radiate nearly isotropically and near the zenith of the upper hemisphere, is not limited to linearly polarized elements and provides an improved antenna pattern design over the upper hemisphere. Reception (radiation in general) near or below the horizon is reduced by the array factor which reduces the response (by field vector cancellation) near the horizon and in the lower hemisphere. The large array configuration offers improved signal rejection near and below the horizon due to superior pattern shaping characteristics over smaller aperture antennas.

The present invention has been described above with reference to exemplary embodiments. However, those skilled in the art having read this disclosure will recognize that changes and modifications can be made to the preferred embodiments without departing from the scope of the present invention. These and other changes or modifications are intended to be included within the scope of the present invention, as expressed in the following claims.

What is claimed is:

1. An antenna system comprising:

a plurality of vertically orientated elements and one of said elements comprising a center element spaced along an axis substantially normal to a horizontal plane, each of said elements being placed $\alpha\lambda/2$ intervals apart and having a corresponding drive coefficient, $\alpha$ being less than unity and predetermined to optimize an antenna pattern for reducing multi-path errors; and a feed network to drive each of said elements, said feed network comprising signal couplers configured to establish an amplitude and a delay line for each of said elements.

2. The antenna system of claim 1, wherein said $\alpha$ is about 0.90 to 0.99.

3. The antenna system of claim 2, wherein said $\alpha$ is 0.90.

4. The antenna system of claim 1, wherein said center element comprises a drive coefficient approximately equal to −6 dB.

5. The antenna system of claim 1 having a substantially circular antenna polarization.

6. The antenna system of claim 1, wherein said plurality of elements comprises crossed, orthogonal, inverted-vee dipoles.

7. The antenna system of claim 1, wherein said plurality of elements are configured to be substantially circularly polarized in a zenith direction and substantially elliptically polarized near the plane.

8. An antenna system having a substantially circular antenna polarization comprising:

a plurality of vertically orientated elements spaced along an axis substantially normal to a horizontal plane, each of said elements being placed at least $\alpha\lambda/2$ intervals apart and having a corresponding drive coefficient, wherein $\alpha$ is defined as a unitless constant less than unity and said plurality of elements configured to reject signals at and below said horizontal plane; and a feed network to drive each of said elements, said feed network comprising signal couplers configured to establish an amplitude and a delay line for each of said elements.

9. The antenna system of claim 8 comprising:

a first element defined as the center element having a drive coefficient approximately equal to −6 dB;

a second element and a third element spaced $\alpha\lambda/2$ from said first element in a substantially vertical direction on either side of said first element;

a fourth element and a fifth element spaced $\alpha\lambda$ from said second and said third elements respectively in a substantially vertical direction; and a sixth element and a seventh element spaced $\alpha\lambda$ from said fourth and said fifth elements respectively in a substantially vertical direction.

10. The antenna system of claim 9, wherein $\alpha$ is in the range of 0.9 to 0.99.

11. The antenna system of claim 10, wherein $\alpha$ is approximately 0.90.

12. The antenna system of claim 8, wherein each of said elements creates an electromagnetic field at a propagation distance corresponding to each of said elements, said propagation distance configured to be a function of an elevation angle relative to said horizontal plane.

13. The antenna system of claim 12, wherein a net electromagnetic field is defined as the combination of all of said distant electromagnetic fields, and said feed network is configured to drive each of said elements such that at a distant observation point, said net electromagnetic field adds for said elevation angles in which signal coverage is desired and subtracts for said elevation angles in which signal rejection is desired.

14. The antenna system of claim 8, wherein said rejection is by about 40 dB relative to signals arriving at said horizontal plane.

15. An antenna system having a substantially circular antenna polarization comprising:

a vertical array of vertical dipoles spaced $\alpha\lambda/2$ along a vertical mast normal to a horizontal plane, wherein $\alpha$ comprises a unitless constant less than unity and said array is further configured to provide coverage of the upper hemisphere substantially above 5° and to provide a sharp cut-off near said plane; and a drive system for providing predetermined amplitude and phases to each of the dipoles in said array.

16. The system of claim 15, wherein said configuration creates an electromagnetic field at a propagation distance corresponding to each of said elements and said propagation distance being a function of an elevation angle relative to said horizontal plane.

17. The system of claim 16, wherein a net electromagnetic field is defined as the combination of all of said distant electromagnetic fields, and said drive system is configured to drive each of said elements such that at a distant observation point, said net electromagnetic field adds for said elevation angles in which signal coverage is desired and subtracts for said elevation angles in which signal rejection is desired.

18. A method for reducing multi-path errors in a ground based antenna system, said method comprising:

forming a linear array comprising a plurality of radiating elements;

supporting said linear array along a vertical mast;

separating said elements by a distance, d, from each other, wherein $d=\alpha\lambda/2$ and $\lambda$ corresponds to an operating wavelength and $\alpha$ is a constant less than unity; and selecting $\alpha$ in accordance with a desired antenna pattern such that below the earth's horizon all sidelobes of said pattern are at least 20 dB down relative to the horizon, wherein said antenna pattern exhibits signal rejection below the horizon.

19. The method of claim 18, wherein said selecting $\alpha$ further comprising selecting in the range of 0.9 to 0.99.

20. The method of claim 18, wherein said selecting $\alpha$ further comprising performing a computer simulation of said desired antenna pattern.

* * * * *